US010107034B2

(12) United States Patent
Salvarezza

(10) Patent No.: US 10,107,034 B2
(45) Date of Patent: Oct. 23, 2018

(54) ENHANCED STRENGTH SPREADER STEP FOR USE WITH ROPE LADDERS

(71) Applicant: Robert M. Salvarezza, Hillsborough, CA (US)

(72) Inventor: Robert M. Salvarezza, Hillsborough, CA (US)

( * ) Notice: Subject to any disclaimer, the term of this patent is extended or adjusted under 35 U.S.C. 154(b) by 0 days.

(21) Appl. No.: 15/427,957

(22) Filed: Feb. 8, 2017

(65) Prior Publication Data

US 2017/0145747 A1 May 25, 2017

Related U.S. Application Data

(63) Continuation-in-part of application No. 14/838,047, filed on Aug. 27, 2015.

(51) Int. Cl.

| | |
|---|---|
| ***E06C 1/56*** | (2006.01) |
| ***E06C 7/08*** | (2006.01) |
| *B63B 27/14* | (2006.01) |

(52) U.S. Cl.

CPC ..... *E06C 7/08* (2013.01); *E06C 1/56* (2013.01); *E06C 7/082* (2013.01); *B63B 27/146* (2013.01)

(58) Field of Classification Search

CPC ... E06C 1/56; E06C 7/08; E06C 7/081; B63B 27/14; B63B 27/146

USPC ..... 182/196–199, 228.6

See application file for complete search history.

(56) References Cited

U.S. PATENT DOCUMENTS

| | | | | | |
|---|---|---|---|---|---|
| 1,349,125 | A * | 8/1920 | Full | B63B 27/14 | 182/196 |
| 2,371,156 | A * | 3/1945 | Dahlander | B63B 27/146 | 182/198 |
| 2,638,260 | A * | 5/1953 | Skolmen | B63B 27/14 | 182/196 |
| 2,943,696 | A * | 7/1960 | Roberts | B63B 27/146 | 182/196 |
| 3,008,537 | A * | 11/1961 | Roberts | E06C 1/56 | 182/196 |
| 3,128,843 | A * | 4/1964 | Anagnostou | E06C 1/56 | 182/198 |
| 3,415,341 | A * | 12/1968 | Hostetler | E06C 1/56 | 182/198 |
| 4,177,878 | A * | 12/1979 | Salvarezza | E06C 1/56 | 182/199 |
| 4,241,809 | A * | 12/1980 | Salvarezza | E06C 1/56 | 182/199 |
| 4,442,920 | A * | 4/1984 | Gronbeck | E06C 1/56 | 182/199 |
| 4,471,854 | A * | 9/1984 | Heilskov | B63B 27/146 | 182/196 |
| 4,554,996 | A * | 11/1985 | Salvarezza | E06C 1/56 | 182/199 |
| 4,655,321 | A * | 4/1987 | Salvarezza | E06C 1/56 | 182/196 |

(Continued)

*Primary Examiner* — Daniel P Cahn

(74) *Attorney, Agent, or Firm* — Squire Patton Boggs (US) LLP

(57) ABSTRACT

This invention relates to a spreader step for a rope ladder comprising a metal scaffold having three types of overlapping elements. There are two parallel elongate elements, two U-shaped elements, the ends of which are inserted into the ends of the parallel elongate elements, and four strengthening elements that are disposed over the other two types of elements at the site of overlap.

13 Claims, 6 Drawing Sheets

(56) References Cited

U.S. PATENT DOCUMENTS

| | | | | | |
|---|---|---|---|---|---|
| 4,683,981 | A * | 8/1987 | Salvarezza | E06C 1/56 | 182/199 |
| 5,605,205 | A * | 2/1997 | Douglas | E06C 1/56 | 182/198 |
| 6,135,239 | A * | 10/2000 | Martin | A62B 5/00 | 182/196 |
| 6,755,281 | B2 * | 6/2004 | Saputo | E04H 4/144 | 182/118 |
| 6,902,037 | B2 * | 6/2005 | Salvarezza | E06C 1/56 | 182/196 |
| 9,611,692 | B1 * | 4/2017 | Rogers | E06C 7/08 | |
| 2004/0031646 | A1 * | 2/2004 | Huang | E06C 1/525 | 182/198 |
| 2005/0045424 | A1 * | 3/2005 | Salvarezza | E06C 1/56 | 182/196 |
| 2008/0289904 | A1 * | 11/2008 | Heiduk | E06C 1/56 | 182/196 |

* cited by examiner

ENHANCED STRENGTH SPREADER STEP FOR USE WITH ROPE LADDERS

RELATED APPLICATIONS

This application is a continuation-in-part of application Ser. No. 14/838,047, filed 27 Aug. 2015, which is incorporated by reference as if fully set forth herein, including the figures.

FIELD

This invention relates to a spreader step for use with rope ladders.

BACKGROUND

The following is provided as background information only. Nothing in this section is intended to be, nor should it be construed as, prior art to the subject invention.

Rope ladders have many uses. For example, they can serve as emergency escape means from buildings, ships at sea and other elevated structures. They are also useful as boarding and disembarking means for ships. In particular, rope ladders are the default means for harbor pilots to board ships to take control of navigating the ships safely to dock. To ensure to the extent possible the safety of rope ladders for marine use, the U.S. Coast Guard has mandated specific requirements for the construction of marine-use rope ladders. Numerous patents have been issued directed to rope ladder construction that meet or exceed Coast Guard specifications.

One of the earliest patents relating to rope ladder construction that comports with Coast Guard regulations is U.S. Pat. No. 4,117,878, filed on 14 Aug. 1978 and issued on 11 Dec. 1979. Historically, rope ladder steps were made of wood. Wood steps, however, are susceptible to warping, breakage and general structural non-uniformity. The advent of superior strength polymers led to the development of molded steps made of tough, durable polymeric materials. Thus, U.S. Pat. No. 4,241,809, filed on 13 Aug. 1979 and issued on 30 Dec. 1980, was directed to rope ladders incorporating such molded elastomer steps. U.S. Pat. No. 4,554,996, filed on 12 Apr. 1985 and issued on 26 Nov. 1985 was directed to improvements to the polymeric steps and to the collars that secure the steps to the ropes of the ladder. U.S. Pat. No. 4,655,321, filed on 29 Aug. 1986 and issued on 7 Apr. 1987, was directed to an improved method for assembling rope ladders comprising molded polymeric steps. U.S. Pat. No. 4,683,981, filed on 4 Aug. 1986 and issued on 4 Aug. 1987, was directed to added beneficial features for molded elastomeric step rope ladders. More recently, U.S. Pat. No. 6,902,037 was filed on 2 Sep. 2003 and was issued on 7 Jun. 2005. The '037 patent is directed to a novel device for securing the rungs of a rope ladder to the ropes. Each of the foregoing patents was issued to Robert. M. Salvarezza, the inventor in the present application, and each of the above patents is incorporated by reference, including all drawings, as if fully set forth herein.

An important aspect, and a necessary one for marine-use rope ladders if they are to meet Coast Guard regulation, is the stability of rope ladders when deployed. Since the ropes are flexible, rope ladders tend to move, particularly to twist, in response to ship movement, wave action and wind, when deployed. To counter this movement, rope ladders may—and in the case of "pilot ladders" must by Coast Guard regulation—employ, in addition to normal rungs that extend only from one of the spaced-apart ropes or set of ropes to the other rope or ropes of the ladder, spreader steps that are substantially longer that the normal rungs and that extend a distance outward in each direction beyond the spaced apart ropes. The spreader steps contact the side of the ship and act as a stabilizing influence for the ladder, countering the tendency of the ladder to move, especially twist, in response to environmental conditions such as those mentioned above.

A problem with spreader steps is their longevity since they are especially prone to wear and tear during use. For instance, since they extend beyond the main bulk of a rope ladder when collapsed, they constitute a very convenient handhold for lifting and carrying the ladder. The weight of the rope ladder that is being borne by spreader steps so used can cause them to bend, even break, which by regulation requires their replacement and essentially renders them unusable, perhaps in critical situations, until such replacement is accomplished. What is needed is a spreader step that is capable of meeting not only Coast Guard regulation relating to resistance to bending and breakage under what the Coast Guard regards as normal use conditions but even to extraordinary use conditions such as that just mentioned above. This invention provides such a spreader step.

SUMMARY

Briefly and in general terms, the present invention is directed to a spreader step.

In an aspect of the invention, a spreader step comprises a metal scaffolding. The metal scaffolding comprises a first elongate tubular element and a second elongate tubular element parallel to the first elongate tubular element, each of the two elongate tubular elements having a left end and a second end. The metal scaffolding further comprises a first U-shaped tubular element and a second U-shaped tubular element, each of the two U-shaped tubular elements having a first end and a second end.

The first end of the first U-shaped tubular element is inserted into the left end of the first elongate tubular element to form a first region of overlap, and the second end of the first U-shaped tubular element is inserted into the left end of the second elongate tubular element to form a second region of overlap.

The first end of the second U-shaped tubular element is inserted into the right end of the first elongate tubular element to form a third region of overlap, and the second end of the second U-shaped tubular element is inserted to the right end of the second elongate tubular element to form a fourth region of overlap.

The metal scaffolding further comprises four strengthening tubular elements, each positioned over a separate one of the four regions of overlap. The strengthening tubular element at each region of overlap has an interior surface contiguous with an outer surface of the left or right end of one of the elongate tubular elements.

There are four through-holes, each located at a separate one of the four regions of overlap. The through-hole at each region of overlap extends through one of the strengthening tubular elements, the left or right end of one of the elongate tubular elements, and the first or second end of one of the U-shaped tubular elements.

BRIEF DESCRIPTION OF THE DRAWINGS

The figures are provided for illustrative purposes only to assist in understanding the invention herein and are not intended nor should they be construed as limiting the scope of this invention in any manner. The figures are not to scale. Some elements of the invention are shown spaced apart for convenience in viewing even though in an actual rope ladder of this invention those elements would be contiguous. The use of the same number in different drawings to identify an element of a device means that that element is the same in both figures.

DETAILED DESCRIPTION

It is understood that, with regard to this description and the appended claims, any reference to any aspect of this invention made in the singular includes the plural and vice versa unless it is expressly stated or unambiguously clear from the context that such is not intended.

As used herein, any term of approximation such as, without limitation, near, about, approximately, substantially, essentially and the like, means that the word or phrase modified by the term of approximation need not be exactly that which is written but may vary from that written description to some extent. The extent to which the description may vary will depend on how great a change can be instituted and have one of ordinary skill in the art recognize the modified version as still having the properties, characteristics and capabilities of the word or phrase unmodified by the term of approximation. In general, but with the preceding discussion in mind, a numerical value herein that is modified by a word of approximation may vary from the stated value by ±10%, unless expressly stated otherwise.

As used herein, the use of "preferred," "presently preferred," "More preferred," "preferably," and the like refers to preferences as they exist at the time of filing of this application.

Figure 1:
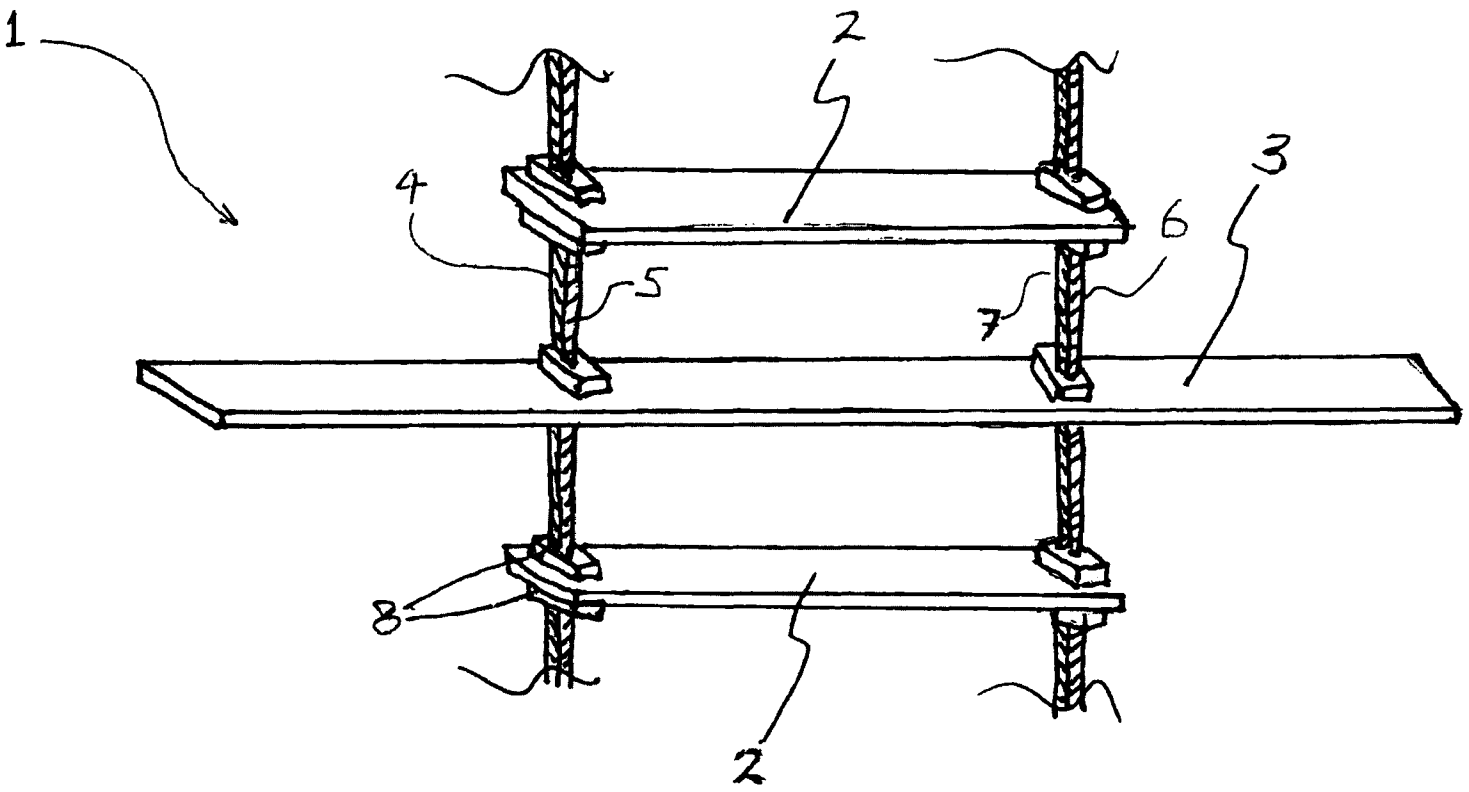
FIG. 1 shows a segment of an example rope ladder in which a spreader step is depicted.

As used herein, a "rope ladder" has the conventional meaning as generally understood by those skilled in the art. That is, a rope ladder comprises two or more ropes or sets of two ropes spaced apart by a series of steps or rungs (the terms are used interchangeably) that are securely coupled to the ropes. While some rope ladders comprise rungs that extend essentially between the ropes only, some rope ladders, in particular those for marine use, also include spreader steps. Spreader steps are steps that extend outward from the ropes for a distance. The purpose of spreader steps is to reduce twisting and flailing about of the rope ladder under the influence of wind, ship motion due to wave action, etc. when the rope ladder is deployed. A segment of a marine rope ladder, in particular a pilot ladder, is shown in FIG. 1. In FIG. 1, rope ladder 1 comprises rungs 2 and spreader step 3 all of which are coupled to rope sets 4/5 and 6/7. Rungs 2 and spreader step 3 are secured to rope sets 4/5 and 6/7 by rope-securing assemblies 8.

As used herein, a "scaffolding" refers to the permanent substructure of a spreader step of this invention to which all of the elements of the spreader step are directly or indirectly coupled and which bestows the strength to the spreader step that is the focus of this invention.

Figure 2:
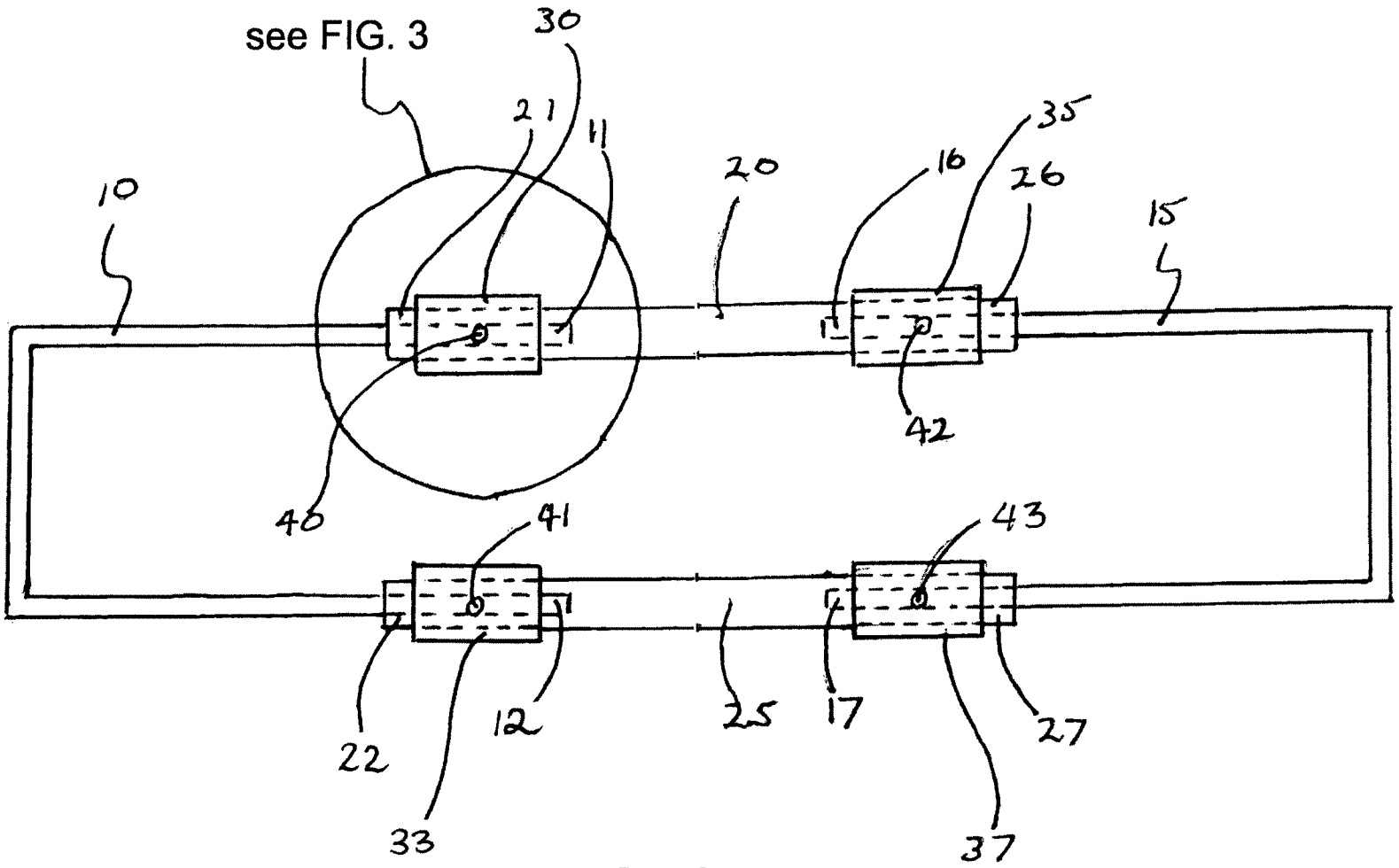
FIG. 2 is a schematic representation of an example scaffolding of a spreader step.

FIG. 2 is a top view of the scaffolding associated with spreader step 3. In FIG. 2, U-shaped elements 10 and 15 are shown with ends 11, 12, 16 and 17 inserted into ends 21, 22, 26 and 27 of parallel elongate elements 20 and 25. Strengthening elements 30, 33, 35 and 37 are positioned over parallel elongate elements 20 and 25 and ends 11, 12 16 and 17 of U-shaped elements 10 and 15 where ends 11, 12, 16 and 17 overlap with ends 21, 22, 26 and 27 of parallel elongate elements 20 and 25. Thus, strengthening elements 30, 33, 35 and 37 overlap both ends 11, 12, 16 and 17 of U-shaped elements 10 and 15 and ends 21, 22, 26 and 27 of parallel elongate elements 20 and 25. Through-holes 40, 41, 42 and 43 pass through all three overlapping elements and are used to couple the three elements and a rope securing assembly together using any type of fastener suitable for the job. Currently preferred are bolts that pass through the through-holes from one end, either from the top or from the bottom of the scaffolding and through holes in the rope securing assembly, and are secured at the other end by nuts.

Each of the elements discussed above comprises a construct that defines a lumen. For the sake of simplicity, such construct will be referred to herein as a "tubular" construct. "Tubular," however, is defined herein not only as the usually associated circular cross-section construct but may assume other cross-sectional conformations such as, without limitation, oval, rectangular, square, or multi-sided. It is presently preferred that the tubular elements of this invention be rectangular, most preferably square, in cross-section. As such, each tubular element has an inner surface that define the lumen of the tube, an outer surface and a thickness between the inner and outer surfaces.

Figure 3:
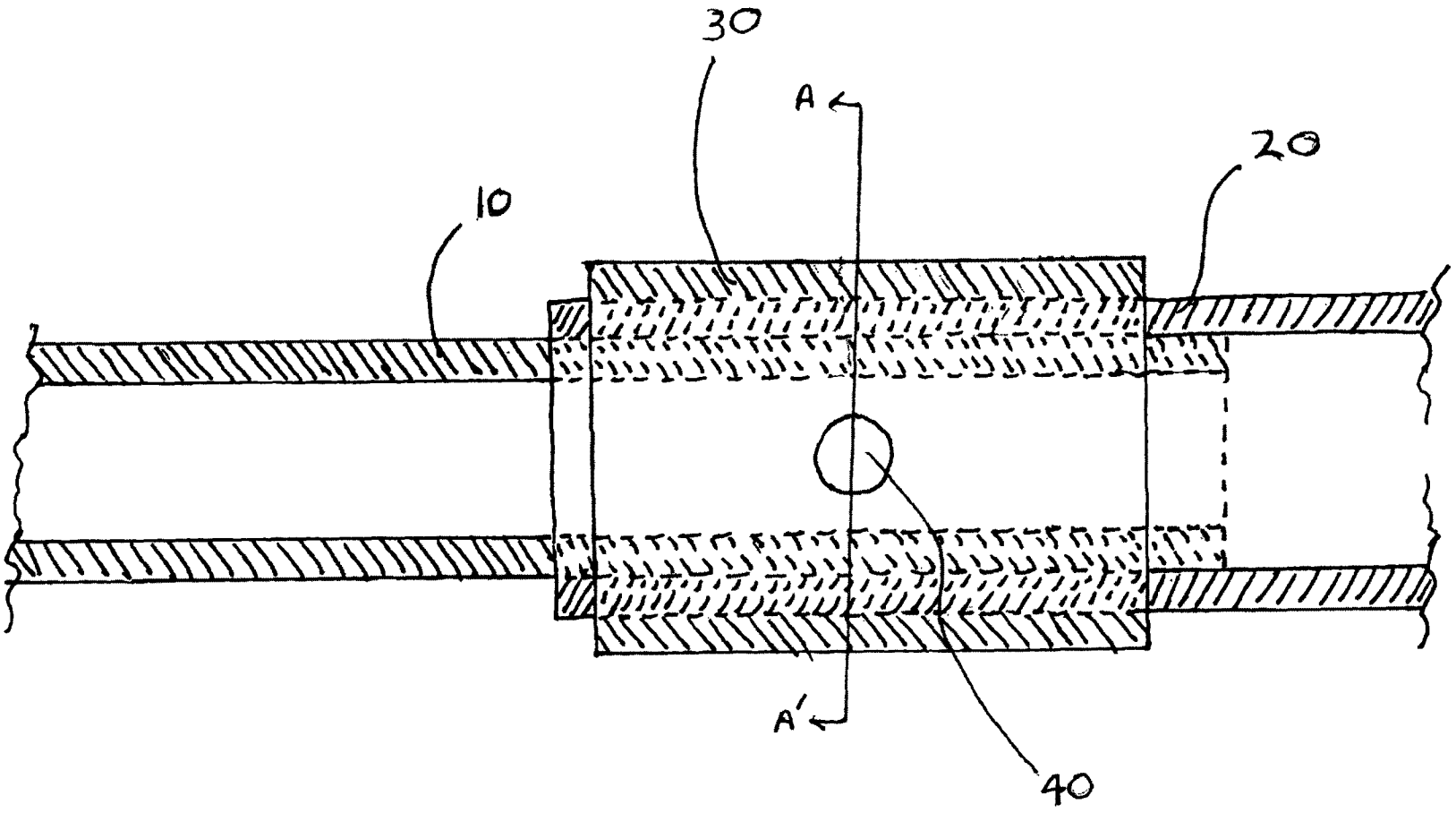
FIG. 3 is an enlarged view of a portion of the scaffolding shown in FIG. 2.
Figure 4:
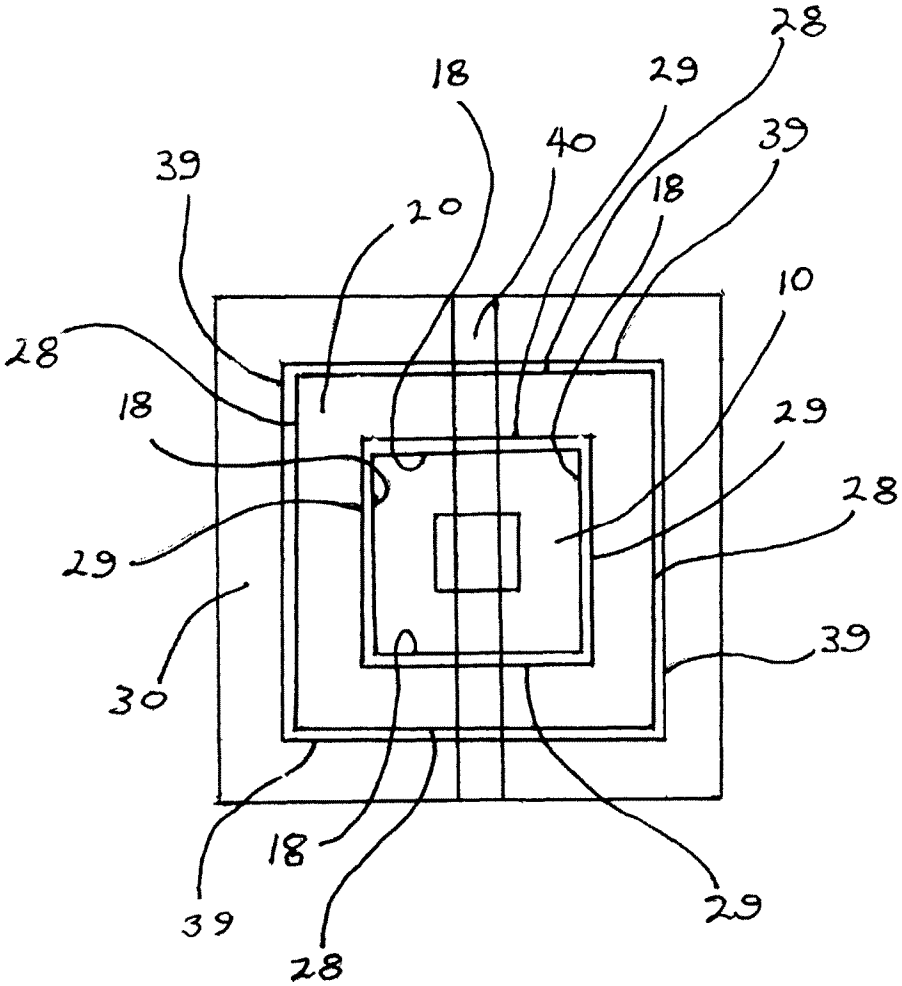
FIG. 4 is a cross-sectional view of the enlarged portion of the scaffolding shown in FIG. 3.

The dimensions of the tubular elements are such that, when ends 11, 12, 16 and 17 of U-shaped elements 10 and 15 are inserted into ends 21, 22, 26 and 27 of parallel elongate elements 20 and 25, outer surfaces 18 of ends 11, 12, 16 and 17 are contiguous with the inner surfaces 29 of ends 21, 22, 26 and 27. Likewise, when strengthening elements 30, 33, 35 and 37 are in place over parallel elongate elements 20 and 25, inner surfaces 39 of the strengthening elements are contiguous with outer surfaces 28 of parallel elongate elements 20 and 25. This relationship among the surfaces of the various elements is depicted in FIG. 3, which is an enlarged view of the indicated portion of FIG. 2, and FIG. 4, which is a cross-sectional view along line A-A' in FIG. 3. In FIG. 4, as mentioned previously herein, surfaces of the three tubular elements are shown spaced slightly apart for the sake of clear depiction of the construct. In fact, the surfaces are contiguous.

All elements of the scaffolding are constructed of strong, light-weight metal, preferably at present, stainless steel, particular 316 stainless steel but other light weight metals such aluminum and strong, light-weight metal alloys can be used and are within the scope of this invention.

Figure 5:
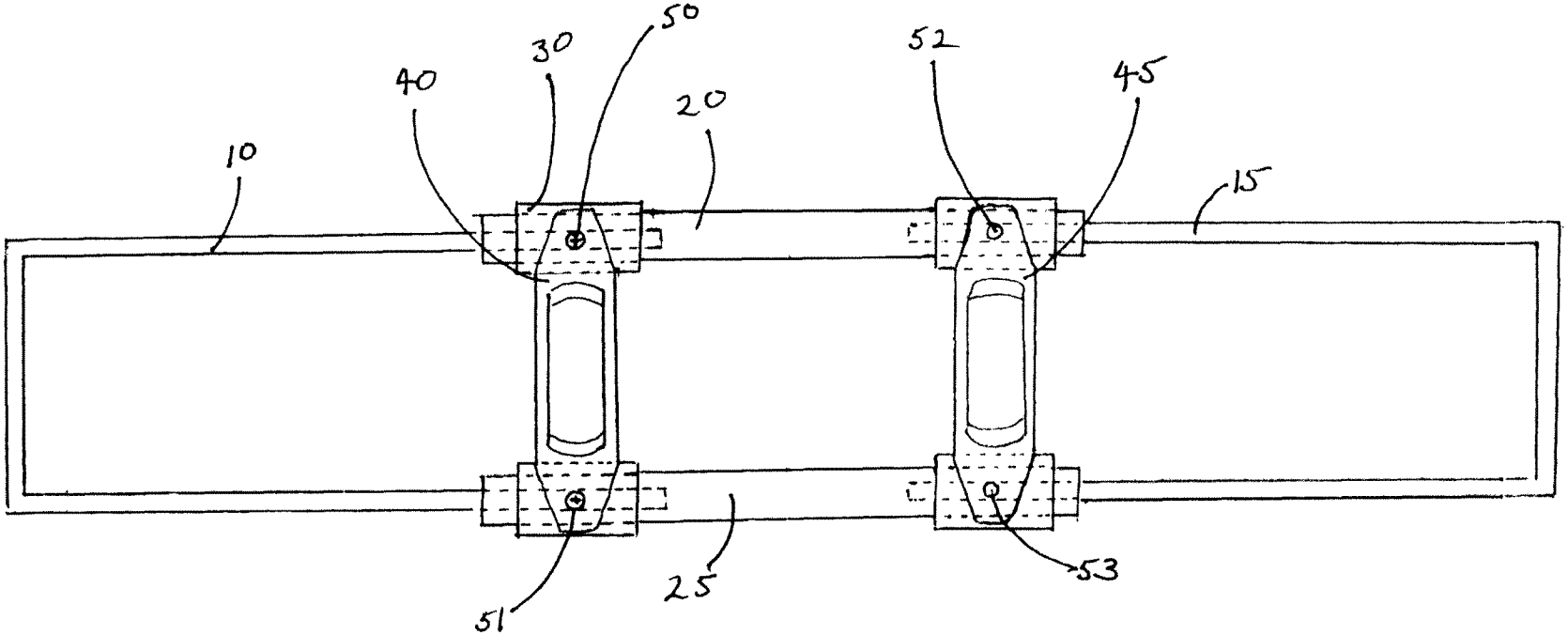
FIG. 5 illustrates an example scaffolding to which exemplary suspension rope securing assemblies are shown coupled to the scaffolding.

A rope securing assembly is, of course, necessary to hold the suspension ropes firmly in place at each step and spreader step. Myriad such securing assemblies are known in the art and others may become known in the future. All such securing assemblies are within the scope of this invention. As an example, FIG. 5 shows rope securing assemblies 40 and 45 in place over the region of overlap of U-shaped elements 10 and 15, parallel elongate elements 20 and 25 and strengthening elements 30 and 35. Bolts pass through through-holes in the three elements of the scaffolding and the through-holes in the rope securing assemblies and are secured by nuts 50, 51, 52 and 53. The rope securing assemblies shown are those disclosed in U.S. Pat. No. 6,902,037, issued on 7 Jun. 2005 and incorporated reference as if fully set forth herein, including any figures. As mentioned previously, the depiction of these rope securing assemblies is for the purpose of illustration only and many other types and forms of rope securing assemblies would be suitable for use with the spreader steps and scaffolding of this invention.

Spreader steps of this invention are capable of withstanding a weight in excess of 2000 lbs, one ton, without exhibiting any deflection of the surface of the step. This far exceeds Coast Guard regulations for spreader steps. While not being held to any particular theory, it is believed that the exceptional strength of spreader steps of this invention lies primarily with the inclusion of the strengthening element to the scaffolding underlying the step. The strengthening element takes pressure off of the bolts holding the scaffolding and ultimately the spreader step and rope securing assemblies together and essentially totally prevents fracture of the spreader step at the bolt sites, which is a common point of step weakness in current spreader steps.

Figure 6:
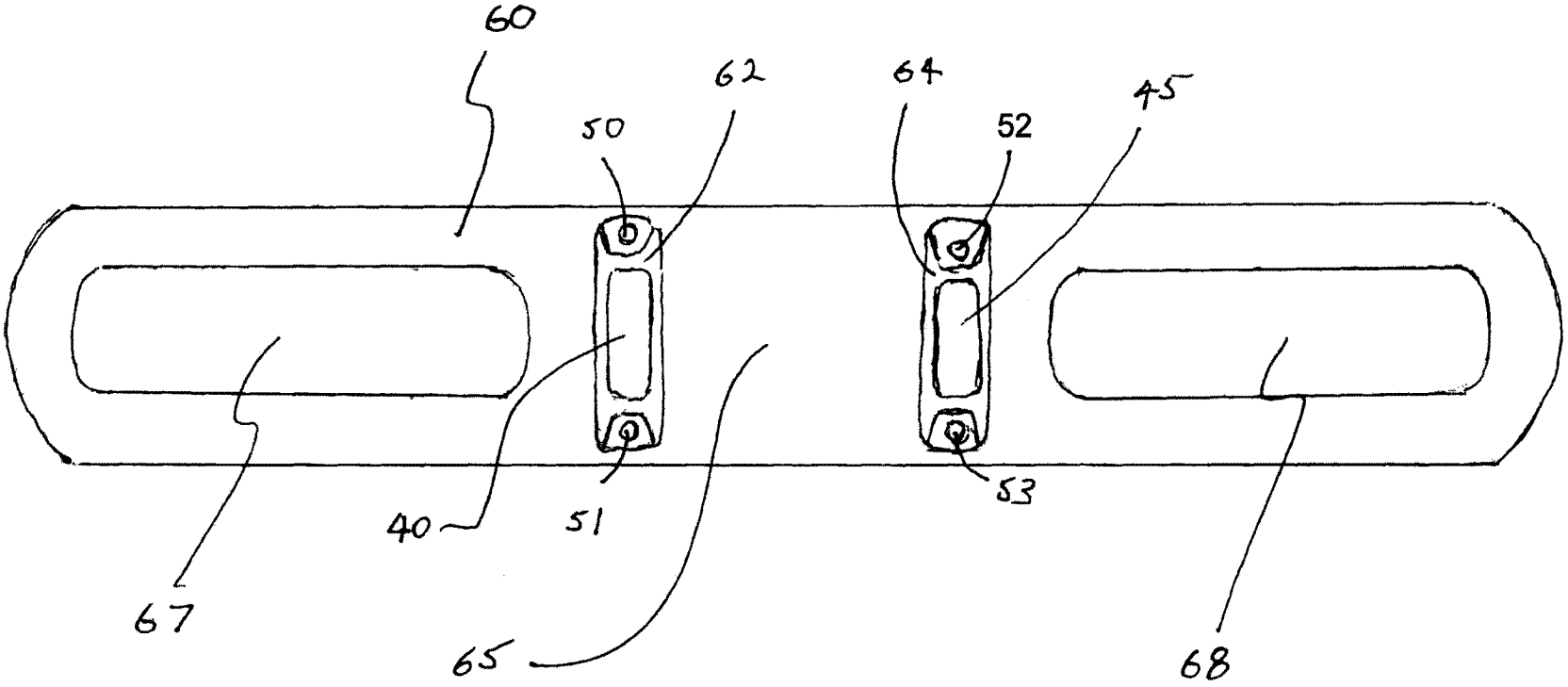
FIG. 6 illustrates an example spreader step in which the scaffolding and rope securing devices are shown embedded in a molded polymeric step body.

A spreader step of this invention further comprises a molded polymeric body in which the scaffolding and rope securing assemblies are embedded. This is illustrated in FIG. 6. In FIG. 6, molded polymeric body 60 is shown with raised portions 62 and 64 that encompass rope-securing elements 40 and 45. Nuts 50, 51, 52 and 53, which secure bolts passing through the through-holes in the scaffold elements and the rope-securing assemblies remain exposed in the completed spreader step. In the region of the spreader step between the suspensions ropes, the polymeric material forms a solid section of material, which constitutes the actual step of the spreader step.

The outboard portions of the spreader step 3 are shown with open areas 67 and 68 in the molded polymeric body. These open areas serve several functions. They lessen the overall weight of the step, they provide a region through which air can pass to reduce the effect of wind on the step and they provide handholds.

Step portion 65 of polymeric body 60 can be formed with a tread surface or can be roughened such as by deposition of grit on the surface before the polymer sets so as to minimize slippage when the rope ladder is in use. Any combination of slip resistant surface treatments may be used. In the outboard areas of spreader step, the polymeric body is more open with slots situated in the body to lighten the overall weight of the rope ladder, to provide an area through which wind can pass without negatively affecting the stability of the rope ladder and to serve as hand holds.

Any high strength polymeric material can be used to create the molded polymeric body including, without limitation, homopolymers, copolymers, composites and combinations thereof. Presently preferred, however, is a copolymer comprising a polyurethane. If a composite is desired, the fillers to be imbedded in the polymer may be, without limitation, fiberglass fibers or fiberglass filaments or carbon fibers or carbon filaments. The inclusion of the fibers or filaments in a polymer enhances the strength and resilience of the polymeric body.

Example

With regard to a spreader step of this invention, in particular a spreader step for use as a pilot ladder, the following dimensions, which meet Coast Guard regulations for such ladders can be used. The length of the normal steps in the pilot ladder is no less than 19" and the width is no less than 4½". The step must be at least 1" thick, excluding any anti-slip surfacing material on the step. The length of a spreader step is no less than 70", the width and thickness being the same as a normal step. All steps, normal and spreader, should be equally spaced no less than 12 and no more than 15 inches apart. The interval between stabilizing steps must be not exceed 9 steps. Presently preferred is a distance of 12¼" between steps, which serves to meet both the Coast Guard mandate and requirement of the International Maritime Pilots' association. The lowest stabilizing step should be the fifth step.

With regard specifically to the spreader steps, the tubular metal scaffolding can comprise the following dimensions:

the parallel elongate elements can each be 30" long and can be constructed of square tubular metal stock having an exterior wall dimension of 0.625" and an interior wall dimension of 0.505";

the two U-shaped elements can each be 56" long. They can be constructed of square tubular metal stock having an exterior wall dimension of 0.5" and an interior wall dimension of 0.380". The ends of the U-shaped tubular elements are inserted into the lumens of the parallel elongate elements such that the overall length of the metal scaffolding is 68", the remaining Coast Guard required length of 70" being provided by a one inch overhang of the molded polymer step at each end of the step; and the strengthening elements can be 3" long and are disposed over the ends of the U-shaped elements and the ends of the parallel elongate elements where those ends overlap. The strengthening elements can be constructed of square tubular metal stock having an exterior wall dimension of 0.75" and an interior wall dimension of 0.652".

What is claimed is:

1. A spreader step configured to be used in a rope ladder and stepped on by a user ascending or descending the rope ladder, the spreader step comprising:

a metal scaffolding comprising:

a first elongate tubular element;

a second elongate tubular element parallel to the first elongate tubular element, each of the two elongate tubular elements respectively having a left end, a right end, and an internal lumen, the internal lumen terminating at a left-facing aperture located at the left end;

a first U-shaped tubular element;

a second U-shaped tubular element, each of the two U-shaped tubular elements respectively having a first end and a second end, the first end of the first U-shaped tubular element inserted into the left end of the first elongate tubular element forming a first region of overlap, the first end of the first U-shaped tubular element passing through the left-facing aperture of the first elongate tubular element and into the internal lumen of the first elongate tubular element, the second end of the first U-shaped tubular element inserted into the left end of the second elongate tubular element forming a second region of overlap, the second end of the first U-shaped tubular element passing through the left-facing aperture of the second elongate tubular element and into the internal lumen of the second elongate tubular element, the first end of the second U-shaped tubular element inserted into the right end of the first elongate tubular element forming a third region of overlap, the second end of the second U-shaped tubular element inserted into the right end of the second elongate tubular element forming a fourth region of overlap;

a first strengthening tubular element positioned over the first region of overlap, wherein the left end of the first elongate tubular element and the first end of the first U-shaped tubular element are disposed within the first strengthening tubular element;

a second strengthening tubular element positioned over the second region of overlap, wherein the left end of the second elongate tubular element and the second end of the first U-shaped tubular element are disposed within the second strengthening tubular element;

four through-holes respectively located at a respective one of said four regions of overlap, a first one of the four through-holes extends through the first strengthening tubular element, the left end of the first elongate tubular element, and the first end of the first U-shaped tubular element, a second one of the through-holes extends through the second strengthening tubular element, the left end of the second elongate tubular element, and the second end of the first U-shaped tubular element, a third of the four through-holes extends through the right end of the first elongate tubular element and the first end of the second U-shaped tubular element, a fourth of the four through-holes extends through the right end of the second elongate tubular element and the second end of the second U-shaped tubular element respectively; and, the spreader step further comprising:

first and second rope securing assemblies secured to the regions of overlap, wherein the metal scaffolding and the rope-securing assemblies are embedded within a polymeric body.

2. The spreader step of claim 1, wherein the metal scaffolding is made of a metal selected from the group consisting of steel, aluminum, and a combination thereof.

3. The spreader step of claim 2, wherein the steel is 316 stainless steel.

4. The spreader step of claim 1, wherein the first rope securing assembly is secured to the first and second regions of overlap; and the second rope securing assembly is secured to the third and fourth regions of overlap.

5. The spreader step of claim 1, wherein the polymeric body is made of a polymer selected from the group consisting of a homopolymer, a copolymer, and a polymeric composite.

6. The spreader step of claim 5, wherein the polymeric body is made of copolymer.

7. The spreader step of claim 6, wherein the copolymer is a polyurethane.

8. The spreader step of claim 1, wherein:

the internal lumens of the first and second elongate tubular elements respectively extend to a right-facing aperture located at the right end of each of the first and second elongate tubular elements, the first end of the second U-shaped tubular element passes through the right-facing aperture of the first elongate tubular element and is disposed within the internal lumen of the first elongate tubular element, and the second end of the second U-shaped tubular element passes through the right-facing aperture of the second elongate tubular element and is disposed within the internal lumen of the second elongate tubular element.

9. The spreader step of claim 1, further comprising a first bolt attaching the first rope-securing assembly to the first region of overlap, and a second bolt attaching the first rope-securing assembly to the second region of overlap, wherein the first bolt passes through the first one of the four through-holes, and wherein the second bolt passes through the second of the four through-holes.

10. The spreader step of claim 1, wherein the first and second ends of the first U-shaped tubular element are parallel to the first and second elongate tubular elements.

11. The spreader step of claim 10, wherein the first and second ends of the second U-shaped tubular element are parallel to the first and second elongate tubular elements.

12. The spreader step of claim 1, further comprising:

a first middle segment between the first and second ends of the first U-shaped tubular element, a second middle segment between the first and second ends of the second U-shaped tubular element, each of the first ends respectively has a first end tip that extends away from each of the respective middle segments and terminates at the first end tip, each of the first end tips being disposed inside of the first elongate tubular element, each of the second ends respectively has a second end tip that extends away from each of the respective middle segments and terminates at the second end tip, each of the second end tips being disposed inside of the second elongate tubular element.

13. The spreader step of claim 12, wherein the first tip of the first U-shaped tubular element faces toward the first tip of the second U-shaped tubular element, and the second tip of the first U-shaped tubular element faces toward the second tip of the second U-shaped tubular element.

* * * * *